US011980937B1

(12) United States Patent
Ramadan et al.

(10) Patent No.: US 11,980,937 B1
(45) Date of Patent: May 14, 2024

(54) ELECTRICAL DOPING OF IRON WITH CHITOSAN NANOEMULSION

(71) Applicant: KING FAISAL UNIVERSITY, Al-Ahsa (SA)

(72) Inventors: Zayed M. Ramadan, Al-Ahsa (SA); Mayson H. Alkhatib, Nizwa (OM)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/392,663

(22) Filed: Dec. 21, 2023

(51) Int. Cl.
*C22C 33/02* (2006.01)
*B22F 1/16* (2022.01)

(52) U.S. Cl.
CPC ..... *B22F 1/16* (2022.01); *C22C 33/02* (2013.01); *B22F 2202/06* (2013.01); *B22F 2301/35* (2013.01); *B22F 2304/058* (2013.01)

(58) Field of Classification Search
None
See application file for complete search history.

(56) References Cited

U.S. PATENT DOCUMENTS

2016/0340668 A1* 11/2016 White ..... C12Q 1/686
2021/0164970 A1* 6/2021 Alocilja ..... H01F 1/0054

FOREIGN PATENT DOCUMENTS

CN 101748113 A * 6/2010
CN 107321972 B 11/2017
CN 110833135 B 2/2020
CN 115444835 A * 12/2022
EP 4152444 A1 3/2023
JP 6926654 B2 8/2021
WO WO-2014081322 A1 * 5/2014

OTHER PUBLICATIONS

English translation of CN 101748113 (originally published Jun. 23, 2010), obtained from PE2E search.*
English translation of CN 115444835 (originally published Dec. 9, 2022), obtained from PE2E search.*
Ayesha Khan, Michael Goepel, Juan Carlos Colmenares, and Roger Gläser "Chitosan-Based N-Doped Carbon Materials for Electrocatalytic and Photocatalytic Applications" https://doi.org/10.1021/acssuschemeng. 9b07522.

* cited by examiner

*Primary Examiner* — George Wyszomierski
(74) *Attorney, Agent, or Firm* — Nath, Goldberg & Meyer; Richard C. Litman

(57) ABSTRACT

Methods for improving the electrical conductivity of iron by coating, or doping, it with a chitosan nanoemulsion. The electrical conductivity of the iron can be improved by increasing the concentration of chitosan in the nanoemulsion, increasing the voltage applied during the doping process, and increasing the duration of the doping process.

14 Claims, 2 Drawing Sheets

ELECTRICAL DOPING OF IRON WITH CHITOSAN NANOEMULSION

BACKGROUND

1. Field

The present disclosure provides a new method for improving the electrical conductivity of iron by coating, or doping, it with a chitosan nanoemulsion.

2. Description of the Related Art

Electrical doping of iron with chitosan is a process of improving the electrical conductivity of iron by coating it with chitosan. Chitosan is a natural polymer derived from shrimp shells and crab exoskeletons. It is a deacetylated chitin, for example, poly (D-glucosamine), has a high affinity for iron, and can form a thin layer on the surface of iron particles. This layer prevents the iron particles from agglomerating.

Accordingly, improved methods for electrically doping iron with chitosan are desired.

SUMMARY

The present subject matter relates to the use of chitosan to form a thin layer on the surface of iron nanoparticles, thereby improving the electrical conductivity of the iron nanoparticles.

In an embodiment, the presently described subject matter relates to a process for electrically doping iron with chitosan, the process comprising: dissolving chitosan in a suitable solvent to obtain a chitosan solution; emulsifying the chitosan solution to obtain a chitosan nanoemulsion; adding iron particles to the chitosan nanoemulsion and mixing well to obtain a mixture; applying a voltage to the mixture to induce the chitosan nanoemulsion to coat the iron particles, thereby forming coated iron particles; collecting the coated iron particles and washing them with water to remove any excess chitosan nanoemulsion; and obtaining iron particles doped with chitosan.

In another embodiment, the presently described subject matter relates to iron particles doped with chitosan prepared according to the processes as described herein.

These and other features of the present subject matter will become readily apparent upon further review of the following specification.

DETAILED DESCRIPTION OF THE PREFERRED EMBODIMENTS

Figure 1:
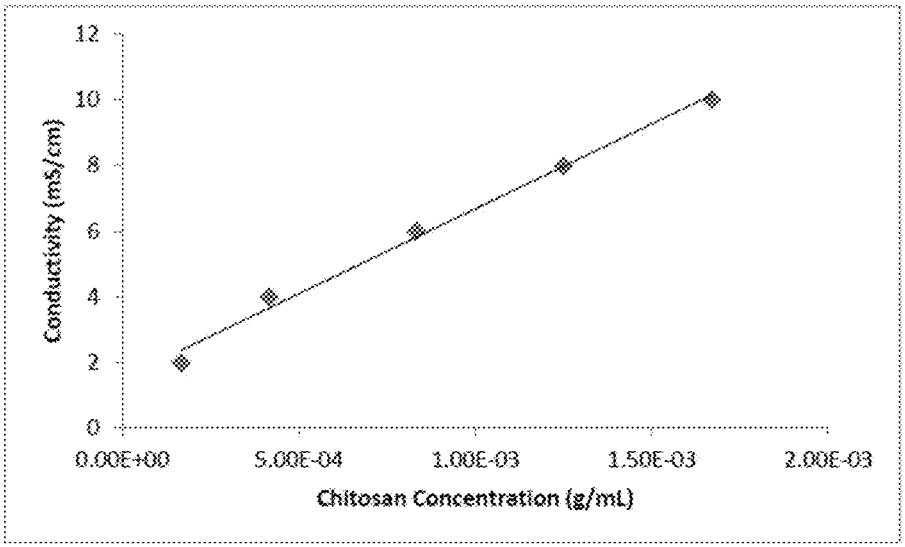
FIG. 1 is a graph showing the effect of chitosan concentration on the conductivity of the coated black iron oxide ($Fe_3O_4$)/chitosan nanoemulsion at a constant applied voltage of 5 volt and doping time of 2 hours.

The following definitions are provided for the purpose of understanding the present subject matter and for construing the appended patent claims.

Definitions

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described event or circumstance may or may not occur, and that the description includes instances where said event or circumstance occurs and instances in which it does not.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Throughout the application, descriptions of various embodiments use "comprising" language. However, it will be understood by one of skill in the art, that in some specific instances, an embodiment can alternatively be described using the language "consisting essentially of" or "consisting of".

For purposes of better understanding the present teachings and in no way limiting the scope of the teachings, unless otherwise indicated, all numbers expressing quantities, percentages or proportions, and other numerical values used in the specification and claims, are to be understood as being modified in all instances by the term "about". Accordingly, unless indicated to the contrary, the numerical parameters set forth in the following specification and attached claims are approximations that may vary depending upon the desired properties sought to be obtained. At the very least, each numerical parameter should at least be construed in light of the number of reported significant digits and by applying ordinary rounding techniques.

In an embodiment, the presently described subject matter relates to a process for electrically doping iron with chitosan, the process comprising: dissolving chitosan in a suitable solvent to obtain a chitosan solution; emulsifying the chitosan solution to obtain a chitosan nanoemulsion; adding iron particles to the chitosan nanoemulsion and mixing well to obtain a mixture; applying a voltage to the mixture to induce the chitosan nanoemulsion to coat the iron particles, thereby forming coated iron particles; collecting the coated iron particles and washing them with water to remove any excess chitosan nanoemulsion; and obtaining iron particles doped with chitosan.

In an embodiment, the emulsifying the of the present processes can be conducted using a high-shear mixer.

In an additional embodiment, the suitable solvent used in the present processes can be acetic acid.

In another embodiment, the chitosan solution of the present processes can further comprise sodium hydroxide. Further, the chitosan solution can be emulsified with a nanoemulsion comprising homogenized isopropyl myristate, a surfactants mixture, and water. In this regard, the surfactants mixture can comprise a polysorbate and sorbitan monolaurate in a 3:1 weight ratio. In addition, the nanoemulsion can comprise about 10% by weight of the isopropyl myristate, about 20% by weight of the surfactants mixture, and about 70% by weight of water.

In a further embodiment, the chitosan solution can be emulsified with the nanoemulsion in an about 1:1 volume ratio.

In yet another embodiment, the iron particles can be iron nanoparticles. In this regard, the iron nanoparticles can be $Fe_3O_4$ nanoparticles. Further, the iron nanoparticles can have an average particle size of about 400 nm to about 500 nm.

In certain embodiments of the present processes, the iron particles can be suspended in the chitosan nanoemulsion.

In other embodiments of the present processes, the voltage applied to the mixture can be from about 1 to about 10 volts. Further, increasing the voltage applied to the mixture can increase conductivity of the iron particles doped with chitosan.

In another embodiment, the presently described subject matter relates to iron particles doped with chitosan prepared according to the processes as described herein.

In this regard, in certain embodiments, the iron particles doped with chitosan can be black iron oxide nanoparticles coated with chitosan. Further, the black iron oxide nanoparticles coated with chitosan can have an average particle size of about 100 to about 200 nm, a density of about 2.5 g/cm$^3$, and a molecular weight of about 2,200. In addition, the black iron oxide nanoparticles coated with chitosan can be prepared using the chitosan nanoemulsion at a concentration of about $8.33\times10^{-4}$ to about $1.25\times10^{-3}$ g/mL.

In certain embodiments in this regard, the black iron oxide nanoparticles coated with chitosan can have electrical conductivities of 2, 4, 6, 8, or 10 mS/cm corresponding to chitosan nanoemulsion concentrations of $1.67\times10^{-4}$, $4.17\times10^{-4}$, $8.33\times10^{-4}$, $1.25\times10^{-3}$ or $1.67\times10^{-3}$) g/mL, respectively. In other words, the electrical conductivity of the iron can be improved by increasing the concentration of chitosan in the nanoemulsion.

Similarly, the electrical conductivity of the iron can be improved by increasing the voltage applied during the doping process or increasing the duration of the doping process.

Iron which is electrically doped with a chitosan nanoemulsion as described herein can have a number of potential applications, including but not limited to improved batteries, corrosion protection, and electromagnetic shielding. In one embodiment in this regard, the present iron nanoparticles electrically doped with a chitosan nanoemulsion electrically doped with a chitosan nanoemulsion can be used in each of these potential applications at temperatures of up to about 100° C.

In this regard, the present iron particles doped with chitosan can be used as an anode material in lithium-ion batteries to improve their energy density and power density.

In a further embodiment, the present iron particles doped with chitosan can be used as a coating material to protect iron from corrosion.

In an additional embodiment, the present iron particles doped with chitosan can be used as an electromagnetic shielding material to block electromagnetic waves.

The following examples relate to various methods of manufacturing certain specific compounds as described herein. All compound numbers expressed herein are with reference to the synthetic pathway figures shown above.

EXAMPLES

Example 1

Preparation of Iron Particles Doped with Chitosan a) Preparation of the chitosan solution: 0.1-1 gram of chitosan is dissolved in 100 mL of 2.5% acetic acid followed by the addition of 200 mL of 1 M sodium hydroxide.

b) Preparation of the nanoemulsion: The nanoemulsion is prepared by homogenizing the weight fractions of 10% isopropyl myristate with a 20% surfactants mixture (Tween80/Span20 at a fixed ratio of 3:1, respectively) and 70% water.

c) The prepared nanoemulsion and chitosan solutions are mixed at a volume ratio of 1:1.

d) The iron (II, III) oxide ($Fe_3O_4$) is suspended in the chitosan nanoemulsion solution.

e) When subjected to a voltage difference the black iron oxide ($Fe_3O_4$) is coated with the chitosan nanoemulsion. In particular, electric charges are distributed among the chitosan nanoemulsion solution and the black iron oxide, causing strong interactions between the black iron oxide nanoparticles and the dispersed nanopores of the chitosan nanoemulsion. The resultant coated $Fe_3O_4$/chitosan nanoemulsion deposits on the working iron electrode. Once the reaction stopped at different selected times (2, 4, 6 and 24 hours), the working electrode was removed.

Example 2

Preparation of $Fe_3O_4$ Nanoparticles

Ferric chloride ($FeCl_3 \cdot 6H_2O$) and ferrous chloride ($FeCl_2 \cdot 4H_2O$) are processed to produce the present iron nanoparticles ($Fe_3O_4$) under nitrogen gas according to the following equation:

$$Fe^{+2}+2Fe^{+3}+8OH \longrightarrow Fe_3O_4+4H_2O$$

The nanoparticle size of the produced iron (II, III) oxide ($Fe_3O_4$) nanoparticles is measured using a zeta sizer as having an average particle size of 400-500 nm.

Example 4

Properties of Iron Oxide Nanoparticles Doped with a Chitosan Nanoemulsion

The resultant coated black iron oxide nanoparticles with the chitosan nanoemulsion of the present processes have a nanometer size of 100-200 nm, a density of 2.5 g/cm$^3$, and a molecular weight of around 2,200.

The concentrations of the chitosan in the chitosan nanoemulsion of $1.67\times10^{-4}$, $4.17\times10^{-4}$, $8.33\times10^{-4}$, $1.25\times10^{-3}$, and $1.67\times10^{-3}$ g/mL result in coated black iron oxide electrical conductivities of 2, 4, 6, 8, and 10 mS/cm, respectively, as shown in FIG. 1.

Figure 2:
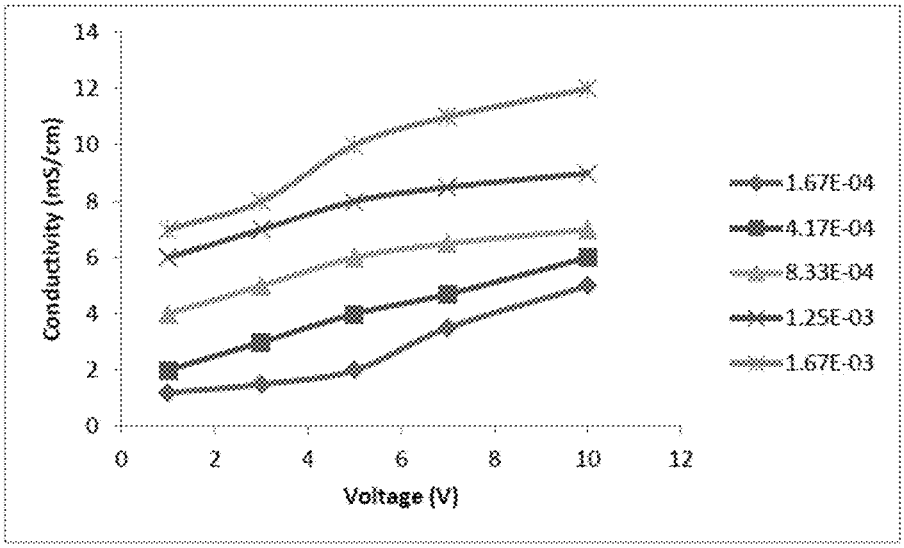
FIG. 2 is a graph showing the effect of applied voltage on the conductivity of the coated black iron oxide ($Fe_3O_4$)/chitosan nanoemulsion at different concentrations (mg/mL) at constant doping time of 2 hours.
Figure 3:
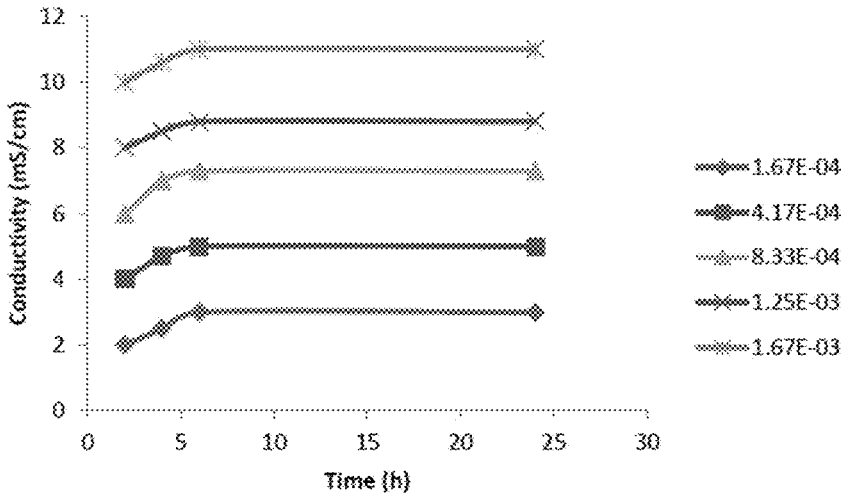
FIG. 3 is a graph showing the effect of doping time on the conductivity of the coated black iron oxide ($Fe_3O_4$)/chitosan nanoemulsion at different concentrations (mg/mL) and constant applied voltage of 5 volt.

Similarly, FIG. 2 shows the effect of applied voltage on the conductivity of the coated black iron oxide (Fe3O4)/chitosan nanoemulsion at different concentrations (mg/mL) at constant doping time of 2 hours, while FIG. 3 shows the effect of doping time on the conductivity of the coated black iron oxide (Fe3O4)/chitosan nanoemulsion at different concentrations (mg/mL) and constant applied voltage of 5 volt.

Example 5

Preparation of N-(3-chlorophenyl)-7H-pyrido[4',3':4,5]pyrrolo[2,3-c][2,7]naphthyridin-5-amine (1)

The expected product is obtained in accordance with the general procedure for the preparation of 5-substituted aminoimidazo[1,2-c]pyrido[3,4-e]pyrimidine-2-carboxylic acid V of Example 4 using 3-chloroaniline as amine.

Elemental Analysis: Calculated C, 56.57; H, 2.97; N, 20.61; Found C, 56.62; H, 2.91; N, 20.57.

Example 6

Preparation of 5-(m-tolylamino)imidazo[1,2-c]pyrido[3,4-e]pyrimidine-2-carboxylic acid (2)

The expected product is obtained in accordance with the general procedure for the preparation of 5-substituted aminoimidazo[1,2-c]pyrido[3,4-e]pyrimidine-2-carboxylic acid V of Example 4 using m-toluidine as amine.

Elemental Analysis: Calculated C, 63.94; H, 4.10; N, 21.93; Found C, 63.91; H, 4.04; N, 21.90.

Example 7

Preparation of 5-((3-methoxyphenyl)amino)imidazo[1,2-c]pyrido[3,4-e]pyrimidine-2-carboxylic acid (3)

The expected product is obtained in accordance with the general procedure for the preparation of 5-substituted aminoimidazo[1,2-c]pyrido[3,4-e]pyrimidine-2-carboxylic acid V of Example 4 using 3-meyhoxyaniline as amine.

Elemental Analysis: Calculated C, 60.89; H, 3.91; N, 20.89; Found C, 60.83; H, 3.88; N, 20.85.

Example 8

Preparation of 5-((3-(dimethylamino)phenyl)amino)imidazo[1,2-c]pyrido[3,4-e]pyrimidine-2-carboxylic acid (4)

The expected product is obtained in accordance with the general procedure for the preparation of 5-substituted aminoimidazo[1,2-c]pyrido[3,4-e]pyrimidine-2-carboxylic acid V of Example 4 using 3-dimethylaminoaniline as amine.

Elemental Analysis: Calculated C, 62.06; H, 4.63; N, 24.12; Found C, 62.03; H, 4.66; N, 24.17.

Example 9

Preparation of 5-((4-chlorophenyl)amino)imidazo[1,2-c]pyrido[3,4-e]pyrimidine-2-carboxylic acid (5)

The expected product is obtained in accordance with the general procedure for the preparation of 5-substituted aminoimidazo[1,2-c]pyrido[3,4-e]pyrimidine-2-carboxylic acid V of Example 4 using 4-chloroaniline as amine.

Elemental Analysis: Calculated C, 56.57; H, 2.97; N, 20.61; Found C, 56.62; H, 3.04; N, 20.59

Example 10

Preparation of 5-(p-tolylamino)imidazo[1,2-c]pyrido[3,4-e]pyrimidine-2-carboxylic acid (6)

The expected product is obtained in accordance with the general procedure for the preparation of 5-substituted aminoimidazo[1,2-c]pyrido[3,4-e]pyrimidine-2-carboxylic acid V of Example 4 using 9-toluidine as amine.

Elemental Analysis: Calculated C, 63.94; H, 4.10; N, 21.93; Found C, 63.98; H, 4.13; N, 21.88.

Example 11

Preparation of 5-((4-methoxyphenyl)amino)imidazo[1,2-c]pyrido[3,4-e]pyrimidine-2-carboxylic acid (7)

The expected product is obtained in accordance with the general procedure for the preparation of 5-substituted aminoimidazo[1,2-c]pyrido[3,4-e]pyrimidine-2-carboxylic acid V of Example 4 using 4-meyhoxyaniline as amine.

Elemental Analysis: Calculated C, 60.89; H, 3.91; N, 20.89; Found C, 60.84; H, 3.84; N, 20.86.

Example 12

Preparation of 5-((4-(dimethylamino)phenyl)amino)imidazo[1,2-c]pyrido[3,4-e]pyrimidine-2-carboxylic acid (8)

The expected product is obtained in accordance with the general procedure for the preparation of 5-substituted aminoimidazo[1,2-c]pyrido[3,4-e]pyrimidine-2-carboxylic acid V of Example 4 using 4-dimethylaminoaniline as amine.

Elemental Analysis: Calculated C, 62.06; H, 4.63; N, 24.12; Found C, 62.01; H, 4.60; N, 24.11.

Example 13

Preparation of 5-((3-(dimethylcarbamoyl)phenyl)amino)imidazo[1,2-c]pyrido[3,4-e]pyrimidine-2-carboxylic acid (9)

The expected product is obtained in accordance with the general procedure for the preparation of 5-substituted aminoimidazo[1,2-c]pyrido[3,4-e]pyrimidine-2-carboxylic acid V of Example 4 using 3-amino-N,N-dimethylbenzamide as amine.

Elemental Analysis: Calculated C, 60.63; H, 4.29; N, 22.33; Found C, 60.55; H, 4.24; N, 22.37

Example 14

Preparation of 5-((3-(N,N-dimethylsulfamoyl)phenyl)amino)imidazo[1,2-c]pyrido[3,4-e]pyrimidine-2-carboxylic acid (10)

The expected product is obtained in accordance with the general procedure for the preparation of 5-substituted aminoimidazo[1,2-c]pyrido[3,4-e]pyrimidine-2-carboxylic acid V of Example 4 using 3-amino-N-methylbenzenesulfonamide as amine.

Elemental Analysis: Calculated C, 52.42; H, 3.91; N, 20.38; Found C, 52.37; H, 3.85; N, 20.41.

Example 15

Preparation of 5-((3-isopropylphenyl)amino)imidazo[1,2-c]pyrido[3,4-e]pyrimidine-2-carboxylic acid (11)

The expected product is obtained in accordance with the general procedure for the preparation of 5-substituted aminoimidazo[1,2-c]pyrido[3,4-e]pyrimidine-2-carboxylic acid V of Example 4 using 3-isopropylaniline as amine.

Elemental Analysis: Calculated C, 65.69; H, 4.93; N, 20.16; Found C, 65.67; H, 4.90; N, 20.13.

Example 16

Preparation of 5-((2-methylpyridin-4-yl)amino)imidazo[1,2-c]pyrido[3,4-e]pyrimidine-2-carboxylic acid (12)

The expected product is obtained in accordance with the general procedure for the preparation of 5-substituted aminoimidazo[1,2-c]pyrido[3,4-e]pyrimidine-2-carboxylic acid V of Example 4 using 2-methylpyridin-4-amine as amine.

Elemental Analysis: Calculated C, 60.00; H, 3.78; N, 26.24; Found C, 60.06; H, 3.72; N, 26.18.

Example 17

Preparation of 5-((3-chlorobenzyl)amino)imidazo[1,2-c]pyrido[3,4-e]pyrimidine-2-carboxylic acid (13)

The expected product is obtained in accordance with the general procedure for the preparation of 5-substituted aminoimidazo[1,2-c]pyrido[3,4-e]pyrimidine-2-carboxylic acid V of Example 4 using 3-chlorobenzyl amine as amine.

Elemental Analysis: Calculated C, 57.72; H, 3.42; N, 19.80; Found C, 57.62; H, 3.49; N, 19.85.

Example 18

Preparation of 5-((pyridin-3-ylmethyl)amino)imidazo[1,2-c]pyrido[3,4-e]pyrimidine-2-carboxylic acid (14)

The expected product is obtained in accordance with the general procedure for the preparation of 5-substituted aminoimidazo[1,2-c]pyrido[3,4-e]pyrimidine-2-carboxylic acid V of Example 4 using pyridin-3-ylmethanamine as amine.

Elemental Analysis: Calculated C, 60.00; H, 3.78; N, 26.24; Found C, 59.96; H, 3.84; N, 26.22

Example 19

Preparation of 5-((3-(dimethylamino)propyl)amino)imidazo[1,2-c]pyrido[3,4-e]pyrimidine-2-carboxylic acid (15)

The expected product is obtained in accordance with the general procedure for the preparation of 5-substituted aminoimidazo[1,2-c]pyrido[3,4-e]pyrimidine-2-carboxylic acid V of Example 4 using 3-(dimethylamino)propyl)amine as amine.

Elemental Analysis: Calculated C, 57.31; H, 5.77; N, 26.74; Found C, 57.27; H, 5.79; N, 26.69.

Example 20

Preparation of 5-((3-(4-methylpiperazin-1-yl)propyl)amino)imidazo[1,2-c]pyrido[3,4-e]pyrimidine-2-carboxylic acid (16)

The expected product is obtained in accordance with the general procedure for the preparation of 5-substituted aminoimidazo[1,2-c]pyrido[3,4-e]pyrimidine-2-carboxylic acid V of Example 4 using 3-(4-methylpiperazin-1-yl)propyl) amine as amine.

Elemental Analysis: Calculated C, 58.52; H, 6.28; N, 26.54; Found C, 58.49; H, 6.22; N, 26.45.

Pharmacological Activity

Example 21

In Vitro Cytotoxic Activity Assay

Compounds 1-16 were screened for their in vitro cytotoxic activity utilizing a 3-(4,5-dimethyl-thiazol-2-yl)-2,5-diphenyltetrazolium bromide (MTT) assay against selected cancer human cell lines consisting of PC3 (prostate), HCT116 (colon), A375 (melanoma), H1299 (lung), MIAPaCa-2 (pancreas), HL60 (leukemia), MCF7 (breast), MDA-MB-231 (breast) (T. Mosmann, J. Immunol. Meth., 1983, 65, 55-63). The cells were cultured at 37° C. in RMPI1640 medium supplemented with 10% fetal bovine serum, 50 IU/mL penicillin, and 50 μg/mL streptomycin in a 5% $CO_2$ incubator. All cells were sub-cultured 3 times/week by trypsinisation. Viable cells were seeded and allowed to adhere for 12 hours before a test drug was added in 96-well plates at an initial density of $1.0\times10^5$ cells/mL. Tumor cell lines were separately exposed to various concentrations of the tested compounds followed by incubation at a temperature of 37° C. during 96 hours inside a medium of fresh RMPI 1640. Cells were subsequently incubated at 37° C. using MTT at 0.5 mg/mL during 4 hours. After removal of supernatant, formazan crystals were dissolved in isopropanol and the optical density was measured at 570 nm. CX-4945 was used as a positive control.

By way of example, the compound (1) displayed promising anti-proliferative activity against human cancer cells as reported in Table 1.

TABLE 1

Cytotoxicity activity of compound of Compound (1) and CX-4945 on various human cancer cells [a]

| Cancer cell lines | Compound (1) | CX-4945 |
|---|---|---|
| PC3 (prostate) | 2.1 | 2.0 |
| HCT116 (colon) | 3.6 | 2.3 |
| A375 (melanoma) | 4.9 | 4.1 |
| H1299 (lung) | 3.2 | 2.3 |
| MIAPaCa-2 (pancreas) | 1.9 | 1.0 |
| HL60 (leukemia) | 5.4 | 3.7 |
| MCF7 (breast) | 5.8 | 9.1 |
| MDA-MB-231 (breast) | 5.3 | 6.2 |

[a] Cells were exposed for 96 hours and the number of viable cells was measured using the MTS reagent. $IC_{50}$ values were calculated as the concentration of compound eliciting a 50% inhibition of cell proliferation expressed in μM.

The biological results demonstrated that the compound (1) displayed promising in vitro anti-proliferative activity against various human cancer cell lines similar to that of CX-4945 used as reference drug.

Example 22

Evaluation of Inhibitory Activity on Protein Kinase CK2

CK2 Kinase Assay was conducted using the protocol as described in Pierre F. et al; *J. Med. Chem.* 2011, 54, 635-654. The tested compounds in aqueous solution were added at a volume of 10 μL to a reaction mixture comprising 10 μL of assay dilution buffer (ADB; 20 mM MOPS, pH 7.2, 25 mM β-glycerol phosphate, 5 mM EGTA, 1 mM sodium orthovanadate, and 1 mM dithiothreitol), 10 μL of substrate peptide (RRRDDDSDDD, dissolved in ADB at a concentration of 1 mM), 10 μL of recombinant human CK2 (RRββ-holoenzyme, 25 ng dissolved in ADB; Millipore). Reactions were initiated by the addition of 10 μL of ATP solution (90% 75 mM$MgCl_2$, 75 μM ATP (final ATP concentration:15 μM) dissolved in ADB; 10% [γ-33P] ATP (stock 1 mCi/100 μL; 3000 Ci/mmol (Perkin-Elmer) and maintained for 10 min at 30° C. The reactions were quenched with 100 μL of 0.75% phosphoric acid and then transferred to and filtered through a phosphor cellulose filter plate (Millipore). After washing each well five times with 0.75% phosphoric acid, the plate was dried under vacuum for 5 min and, following the addition of 15 μL of scintillation fluid to each well, the residual radioactivity was measured using a Wallac luminescence counter. The $IC_{50}$ values were derived from eight concentrations of test inhibitors.

The biological results demonstrated that the present compounds possessed favourable CK2 inhibition with $IC_{50}$ at a nanomolar concentration range.

By way of example, the compound (1) displayed promising protein kinase CK2 activity with an $IC_{50}$ of 41 nM, while in the same experimental condition, the reference control CX-4945 inhibited protein kinase CK2 activity of 1 nM.

It is to be understood that the imidazo[1,2-c]pyrido[3,4-e]pyrimidine-2-carboxylic acid compounds are not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A process for electrically doping iron with chitosan, the process comprising:

dissolving chitosan in a suitable solvent to obtain a chitosan solution;

emulsifying the chitosan solution to obtain a chitosan nanoemulsion;

adding iron particles to the chitosan nanoemulsion and mixing well to obtain a mixture;

applying a voltage to the mixture to induce the chitosan nanoemulsion to coat the iron particles, thereby forming coated iron particles;

collecting the coated iron particles and washing them with water to remove any excess chitosan nanoemulsion; and obtaining iron particles doped with chitosan.

2. The process for electrically doping iron with chitosan of claim 1, wherein the emulsifying is conducted using a high-shear mixer.

3. The process for electrically doping iron with chitosan of claim 2, wherein the chitosan solution is emulsified with a nanoemulsion comprising homogenized isopropyl myristate, a surfactants mixture, and water.

4. The process for electrically doping iron with chitosan of claim 3, wherein the surfactants mixture comprises a polysorbate and sorbitan monolaurate in a 3:1 weight ratio.

5. The process for electrically doping iron with chitosan of claim 3, wherein the nanoemulsion comprises about 10% by weight of the isopropyl myristate, about 20% by weight of the surfactants mixture, and about 70% by weight of water.

6. The process for electrically doping iron with chitosan of claim 2, wherein the chitosan solution is emulsified with the nanoemulsion in an about 1:1 volume ratio.

7. The process for electrically doping iron with chitosan of claim 1, wherein the suitable solvent is acetic acid.

8. The process for electrically doping iron with chitosan of claim 7, wherein the chitosan solution further comprises sodium hydroxide.

9. The process for electrically doping iron with chitosan of claim 1, wherein the iron particles are iron nanoparticles.

10. The process for electrically doping iron with chitosan of claim 9, wherein the iron nanoparticles are $Fe_3O_4$ nanoparticles.

11. The process for electrically doping iron with chitosan of claim 9, wherein the iron nanoparticles have an average particle size of about 400 nm to about 500 nm.

12. The process for electrically doping iron with chitosan of claim 1, wherein the iron particles are suspended in the chitosan nanoemulsion.

13. The process for electrically doping iron with chitosan of claim 1, wherein the voltage applied to the mixture is from about 1 to about 10 volts.

14. The process for electrically doping iron with chitosan of claim 13, wherein the voltage applied to the mixture and a conductivity of the iron particles doped with chitosan exhibit a positive correlation.

* * * * *